United States Patent [19]

Jao et al.

[11] Patent Number: 4,954,272

[45] Date of Patent: Sep. 4, 1990

[54] PROCESS FOR PREPARING OVERBASED CALCIUM SULFONATES

[75] Inventors: Tze C. Jao, Fishkill; Nancy A. Morton, Hopewell Junction, both of N.Y.; Robert W. Erickson, Jr., Nederland, Tex.

[73] Assignee: Texaco Inc., White Plains, N.Y.

[21] Appl. No.: 329,129

[22] Filed: Mar. 27, 1989

[51] Int. Cl.[5] ..... C10M 135/10

[52] U.S. Cl. ..... 252/25; 252/33; 252/33.4; 252/18; 252/39

[58] Field of Search ..... 252/39, 33, 18, 25, 252/33.4

[56] References Cited

U.S. PATENT DOCUMENTS

| | | | |
|---|---|---|---|
| 4,086,170 | 4/1978 | De Clippeleir | 252/33 |
| 4,137,184 | 1/1979 | Bakker | 252/33 |
| 4,165,291 | 8/1979 | Gragson | 252/33 |
| 4,427,559 | 1/1984 | Whittle | 252/33.4 X |
| 4,604,219 | 8/1986 | Whittle | 252/33 |
| 4,780,224 | 10/1988 | Jao | 252/33 |
| 4,824,584 | 4/1989 | Muir | 252/38 |

*Primary Examiner*—Olik Chaudhuri
*Assistant Examiner*—James M. Hunter, Jr.
*Attorney, Agent, or Firm*—Robert A. Kulason, James J. O'Loughlin, Vincent A. Mallare.

[57] ABSTRACT

A process for producing an overbased oil soluble calcium sulfonate having a TBN of 325, said process comprising:

(a) diluting a neutral calcium sulfonate with a hydrocarbon solvent and a lower alkanol;

(b) adding to the diluted calcium sulfonate solution, CaO, $Ca(OH)_2$ and $H_2O$ in molar ratios of CaO:-$Ca(OH)_2$ of about 90:10 to about 20:80 and of $H_2O$:-CaO of about 0.15:1 to about 0.30:1;

(c) heating the sulfonate mixture to a temperature ranging from about 100° F. to about 170° F. under a pressure ranging from about 0 to about 50 psig;

(d) passing $CO_2$ into the heated sulfonate mixture for a period of about 50 to about 200 minutes;

(e) adding a diluent oil to the $CO_2$ treated sulfonate mixture;

(f) separating the solids from the liquid of the sulfonate mixture; and (g) stripping the hydrocarbon solvent from the resulting over-based oil soluble sulfonate product having TBN of 325.

7 Claims, No Drawings

PROCESS FOR PREPARING OVERBASED CALCIUM SULFONATES

BACKGROUND OF THE INVENTION

This invention is an improved process for preparing overbased calcium sulfonates which are used as detergent and reserve alkalinity lubricating oil additives.

In the course of operation, internal combustion engines convert lubricating oil to acidic degradation products. Those acidic degradation products attack and corrode engine parts and catalyze the formation of sludge, thereby reducing lubricity and accelerating wear of moving parts in contact with the lubricating oil.

It is desirable to add basic substances to the lubricating oil which neutralize acids as they are formed in the engine before they reach concentrations sufficient to cause corrosion or to catalyze the sludge reaction. Adding an alkalinity agent to the detergent in motor oil is known as overbasing. Colloidal carbonates of the alkaline earth metals have been found to be well suited for this purpose. These carbonate dispersions are stabilized by oil soluble surface active agents with the sulfonates of the alkaline earth metals in which the sulfonic acid portion of the molecule has a molecular weight of preferably 350 to 600. The sulfonates are made by sulfonation of lubricating oil fractions from petroleum and by sulfonation of alkyl benzenes having the desired molecular weight for this purpose. Benzene alkylates with straight chain alkyl groups are especially desirable.

In general, the process of preparing oils which contain overbased calcium sulfonates comprises reacting a solution of alkylbenzene sulfonic acids having a molecular weight greater than 400, in oil with calcium oxide or hydroxide and bubbling carbon dioxide through the reaction mixture; thereby incorporating an excess of calcium carbonate into the calcium sulfonate which confers reserve alkalinity to the product.

Thus, it is an object of the present invention to provide a method of producing overbased calcium sulfonates that contain only amorphous calcium carbonate.

DISCLOSURE STATEMENT

U.S. Pat. No. 4,427,559 to Jr. R. Whittle discloses that a mixture of calcium oxide and calcium hydroxide can be used in the overbased reaction to provide reserve alkalinity to neutral calcium sulfonates. It is reported that when mixtures containing up to 30 percent CaO are used, satisfactory products were obtained. When mixtures of 30 to 50 percent CaO were used, a gelatinous material which plugged the filter were obtained. Concentrations of CaO above 70 percent produced a fluid product containing finely divided particles which could not be filtered and were reflective of light. In this regard, the patent teaches the criticality of the ratio of the calcium oxide to calcium hydroxide in the absence of a promoter in producing acceptable product.

U.S. Pat. No. 4,604,219 to Jr. R. Whittle discloses that calcium oxide may be used as the sole reserve alkalinity source in overbasing calcium sulfonates. This patent teaches, in the absence of a promoter, that water addition rate and amount are critical in producing a low solids content, filterable product.

U.S. Pat. No. 4,086,170 to DeClippeleir, et.al. discloses that overbased calcium sulfonates are prepared by reacting a solution of alkylbenzene sulfonic acids with an excess of a calcium oxide having a medium or low activity toward water and with carbon dioxide.

Improved overbasing and filterability of the overbased sulfonate solution were obtained by the use of a promoter for the conversion of the calcium oxide to calcium hydroxide. Recommended promoters include ammonia or organic bases such as monoamines or diamines, e.g. ethylene diamine.

SUMMARY OF THE INVENTION

The invention is an improved process for preparing an overbased oil soluble calcium sulfonate having a TBN of 325. The process comprises:

(a) diluting a neutral calcium sulfonate with a hydrocarbon solvent and a lower alkanol;

(b) adding to the diluted calcium sulfonate solution, CaO, $Ca(OH)_2$ and $H_2O$ in molar ratios of CaO/-$Ca(OH)_2$ of about 90:10 to about 20:80 and of $H_2O$/CaO of about 0.15:1 to about 0 50:1;

(c) heating the sulfonate mixture to a temperature ranging from about 100° F. to about 170° F. under a pressure ranging from about 0 to about 50 psig;

(d) passing $CO_2$ into the heated sulfonate mixture for a period of about 50 to about 200 minutes;

(e) adding a diluent oil to the $CO_2$ treated sulfonate mixture;

(f) separating the solids from the liquid of the sulfonate mixture; and (g) stripping the hydrocarbon solvent from the resulting over-based oil soluble sulfonate product having TBN of 325.

In the present process the molar ratio of H20:CaO ranges from about 0.2:1 to about 0.3:1 and

DETAILED DESCRIPTION OF THE INVENTION

The invention is an improvement in U.S. patent application Ser. No. 129,618 filed Dec. 12, 1987 for a "Process for Preparing Overbased Calcium Sulfonates" to Tze-chi Jao, et.al.

A process for overbasing calcium sulfonates has been discovered based on the use of a mixture of calcium oxide and calcium hydroxide in specified proportion as the source of inorganic calcium. The entire charge of water is added before the carbonation in an amount of 15 to 30 mole% of the calcium oxide. A clear product with a low solid waste is produced.

It is known to produce overbased sulfonates by means of calcium oxide alone or a mixture of calcium oxide and calcium hydroxide. Overbased sulfonates produced from calcium oxide-calcium hydroxide mixtures are noted for a hazy product with a relatively low level of overbasing. The instant invention is distinguished in the recognition that calcium oxide:calcium hydroxide ratio is essential to produce a clear, low solids content mixture for filtering.

The use of calcium hydroxide alone is undesirable because it typically produces a high solids content product and demonstrates low sulfonate utilization. Applicant's Ser. No. 07/129/618 filed Dec. 12, 1987 achieved an improvement in using calcium oxide alone. This process produced a clear product containing only amorphous calcium carbonate and a higher sulfonate utilization. The instant process is distinguished from Serial No. 07/129,618 by a simplified process scheme while demonstrating equivalent sulfonate utilization and low solids content.

The operating parameters of the present process are tabulated below in Table I.

TABLE I

| Variable | Operable Range | Preferred Range |
|---|---|---|
| Reaction Temperature | 100° to 170° F. | 130° to 150° F. |
| Pressure | 1 to 5 atm | 1 to 2.5 atm |
| Mole ratio $CaO/Ca(OH)_2$ | 9.0:0.25 | 5.7:1.5 |
| Mole ratio $H_2O/CaO$ | 0.15 to 0.5 | 0.2 to 0.3 |
| Mole ratio $CO_2/CaO + Ca(OH)_2$ | 0.5 to 0.95 | 0.6 to 0.9 |
| Hydrocarbon Solvent | 37 to 70 wt. % | 40 to 60 wt. % |
| Alcohol | 4.5 to 10.0 wt. % | 5.0 to 8.0 wt. % |
| Carbonation and Hydration time | 60 to 240 min. | 60 to 180 min. |

Examples of useful and preferred reactants which may be employed in the practice of the invention are listed below in Table II.

TABLE II

| Reactants | Example | Preferred Reactants |
|---|---|---|
| Calcium Oxide | | One with a total slaking time of 4.5 to 35 min. and a temperature rise of 6° C. max in the 1st 30 sec. as measured by ASTM C-100 76a. |
| Calcium Sulfonate | Neutralized sulfonic acid derived from a natural feedstock. Neutralized sulfonic acid derived from a synthetic feedstock. Blends of neutralized sulfonic acids from natural and synthetic feedstocks. | Blends of neutralized sulfonic acids from natural and synthetic feedstocks. |
| Diluent Oil | 100–500 SUS (at 40° C.) pale stock. 100–500 SUS solvent neutral oil. | 100 SUS pale stock hydrofinished. |
| Hydrocarbon Solvent | Straight run gasoline, dehexanized raffinate gasoline, normal or mixed hexanes, normal or mixed heptanes, benzene or toluene. | Crude heptane |
| Lower alcohols | $C_1$–$C_5$normal or branched chain alcohols | Methanol |

This invention is better shown by way of the following examples wherein the advantages will be more apparent.

EXAMPLE I

A blend containing 53.2 parts of a normal sulfonate by weight, plus 87 parts n-heptane, plus 12.3 parts methanol, plus 15.3 parts calcium oxide and 3.6 parts calcium hydroxide, plus 0.11 parts calcium chloride was brought to reflux (62° C.) in a 500 ml 4-neck reaction flask. The resultant mixture was refluxed for an additional 10 minutes. Water, 0.8 parts, was added immediately before $CO_2$ charge. $CO_2$ was then introduced into the reaction mixture at a rate of 40 ml/min. The $CO_2$ treatment was stopped at 135 minutes after the $CO_2$ addition had started. At the end of the reaction, 14 parts of pale oil was added and stirred for an additional 10 minutes.

The filtered and solvent-stripped final product was clear and had a TBN value of about 325. Its IR spectrum showed a symmetric band centered around 865 cm (−1) indicating amorphous calcium carbonate.

In Example I and the following Examples, the mole ratio of $$CO_2/[CaO+Ca(OH)_2]$$

is related to the type of product and the acceptability of the product. For instance, the above ratio of Example I is determined first by comparing the charge and mole of each reactant as shown below in Table III.

TABLE III

| Reactants | Charge in gm | Charge in mole |
|---|---|---|
| CaO | 10.6 | 0.1893 mole |
| $Ca(OH)_2$ | 9.3 | 0.1257 mole |
| $CO_2$ | 135 mins at 40 ml/min | 0.2411 mole* |

*Mole of $CO_2$ = 135 min × 40 ml/min/2400 ml/mole = 0.2411

Then the mole ratio is determined as follows:

$$CO_2/[CaO + Ca(OH)_2] = 0.2411/(0.1893 + 0.1257 = 0.77)$$

If the mole ratio of $CO_2/[CaO+Ca(OH)_2]$ is lower than 0.80, the TBN will be lower. If this mole ratio is higher than 0.9, the product will contain undesirable crystalline $CaCO_3$. In practice, the reasons for not charging $CO_2$ passing 0.8 is to leave room for operational errors.

EXAMPLE II

A blend containing 17.3 parts normal calcium sulfonate by weight, plus 28.3 parts crude heptane, plus 4.0 parts methanol, plus 4.9 parts calcium oxide, plus 1.1 parts calcium hydroxide and 0.03 part calcium chloride was heated to 40° C. in a 10-gallon reactor. Water, 0.3 part, was added. The reaction mixture was heated to reflux (60° C). $CO_2$ was introduced by a sparge into the mixture at a rate of 5.2 liter/min as soon as the reaction mixture reached the reflux temperature. The $CO_2$ treatment was stopped at 180 minutes after the $CO_2$ addition had started. At the end of the reaction 4.5 parts of pale oil was added and stirred for an additional 10 minutes.

The filtered and solvent-stripped final product was clear and had a TBN value of 325. Its IR spectrum showed a symmetric band centered around 865 $cm^{-1}$ indicating amorphous calcium carbonate. The lime and sulfonate utilizations were 86 percent and 100 percent, respectively, while the solid volume in the crude product was about 3 percent. On the contrary, the mixed lime process (Whittle's process U.S. Pat. No. 4,427,559) produced a solid waste volume of about 13–15 percent.

EXAMPLE III

A blend containing 26.9 parts calcium sulfonate by weight, plus 44.1 parts crude heptane, plus 6.3 parts methanol, plus 1.8 parts calcium hydroxide, plus 7.7 parts calcium oxide and 0.05 part calcium chloride was heated to 40° C. in a 500-gallon reactor. Water, 0.5 part, was added. The reaction mixture was heated to reflux (60° C.). $CO_2$ was introduced by a sparge into the mixture at a rate of 234 liters/min as soon as the reaction mixture reached the reflux temperature The $CO_2$ treatment was stopped 188 minutes after the $CO_2$ addition had started. At the end of the reaction 7.1 parts of pale oil was added and stirred for an additional 10 minutes.

The filtered and solvent-stripped final product was clear and had a TBN value of 320. Its IR spectrum 25 a symmetric band centered around 865 $cm^{-1}$ indicating amorphous calcium carbonate. The lime and sulfonate utilizations were 86.2 percent and 99.2 percent, respectively, while the solid volume in the crude product was about 9 percent.

In order to show the effectiveness and advantage of the present invention, a 400 TBN sulfonate was compared with a 300 TBN sulfonate which is similar to that of the present invention. The results of the evaluation/-comparison of the sulfonates is provided below in Table IV.

TABLE IV

ENGINE PERFORMANCE COMPARISON BETWEEN 400 TBN AND 300 TBN SULFONATE PRODUCTS[1]

| | 400 TBN Sulfonate Diluted with Meutral Sulfonate | 300 TBN Sulfonate[2] | CC Limit |
|---|---|---|---|
| % Ca | 0.20 | 0.21 | |
| % sulfonate | 0.57 | 0.57 | |
| wt. % | 1.93 | 1.73 | |
| Caterpillar 1H2 | | | |
| 120 hrs, % TGF[3] | 19 | 7 | |
| 120 hrs, % TWD[4] | 66 | 39 | |
| 420 hrs, % TGF | 44 | 14 | 45 |
| 420 hrs, % TWD | 159 | 81 | 140 |

[1]In a SF/cc additive package
[2]The TBN of the mixture was adjusted to 300 TBN
[3]TGF stands for top groove fill
[4]TWD stands for total weight of demerit
GLOSSARY TBN – Total Base Number = $\frac{\text{milligrams KOH}}{\text{gram sample}}$ TBN; ranging from 0 to 325 is the measure of the overbasing of 10 to 40 wt.% calcium sulfonate with 0 to 50 wt.% CaO, $Ca(OH)_2$, $CaCO_3$ or mixture thereof.

While particular embodiments of the invention have been described, it will be understood, of course, that the invention is not limited thereto since many modifications may be made and it is, therefore, contemplated to cover by the appended claims any such modifications as fall within the true spirit and scope of the invention.

We claim:

1. A process for producing an overbased oil soluble calcium sulfonate having a TBN of 325, said process comprising:
   (a) diluting a neutral calcium sulfonate with a hydrocarbon solvent and a lower alkanol;
   (b) adding to the diluted calcium sulfonate solution, CaO, $Ca(OH)_2$ and $H_2O$ in molar ratios of CaO:-$Ca(OH)_2$ of about 90:10 to about 20:80 and of $H_2O$:-CaO of about 0.15:1 to about 0.30:1;
   (c) heating the sulfonate mixture to a temperature ranging from about 100° F. to about 170° F. under a pressure ranging from about 0 to about 50 psig;
   (d) passing $CO_2$ into the heated sulfonate mixture for a period of about 50 to about 200 minutes;
   (e) adding a diluent oil to the $CO_2$ treated sulfonate mixture;
   (f) separating the solids from the liquid of the sulfonate mixture; and
   (g) stripping the hydrocarbon solvent from the resulting over-based oil soluble sulfonate product having TBN of 325.

2. The process according to claim 1 wherein the molar ratio of $H_2O$:CaO ranges from about 0.2:1 to about 0.3:1.

3. The process of claim 1 wherein the hydrocarbon solvent is a ($C_5$–$C_{15}$) alkane, toluene, xylene or naphthalene.

4. The process of claim 1 wherein the alkanol is ($C_1$–$C_4$) alkanol.

5. The process of claim 1 wherein the $CO_2$ is passed into the sulfonate mixture for a period ranging from about 60 to about 140 minutes.

6. The process of claim 1 wherein the volume of solids ranged from about 2.5 percent to about 9.0 minutes.

7. The process of claim 6 wherein the volume of solids is about 8.0 percent.

* * * * *